United States Patent [19]

Rader

[11] Patent Number: 4,798,304

[45] Date of Patent: Jan. 17, 1989

[54] COLLAPSIBLE BOX

[75] Inventor: Helmut Rader, McLean, Va.

[73] Assignee: Monoflo International, Inc., McLean, Va.

[21] Appl. No.: 105,573

[22] Filed: Oct. 8, 1987

[51] Int. Cl.[4] ..... B65D 7/24

[52] U.S. Cl. ..... 220/6; 220/337; 220/1.5

[58] Field of Search ..... 220/6, 337, 1.5

[56] References Cited

U.S. PATENT DOCUMENTS

| | | | |
|---|---|---|---|
| 3,655,088 | 4/1972 | Box | 220/337 |
| 3,796,342 | 3/1974 | Sanders et al. | 220/6 |
| 4,302,866 | 12/1981 | Irvin | 220/337 X |
| 4,320,845 | 3/1982 | Waller | 220/337 X |
| 4,693,387 | 9/1987 | Stonier | 220/6 |

*Primary Examiner*—Steven M. Pollard
*Attorney, Agent, or Firm*—Nixon & Vanderhye

[57] ABSTRACT

A collapsible box is manufactured simply and inexpensively, and can support hanging files in a secure manner. The box components are all constructed of plastic, and pivotal connections between all of the components (to provide for the collapsing and erecting action) are provided solely by plastic pivot pins integral with the plastic components, and pivot pin receiving openings formed in the plastic components. The pivotal elements snap together and are disassemblable, so that the container may be easily assembled together and may be taken apart without the necessity of removing accessory elements that have been specifically inserted to pivotally connect the components together. Metal bars for supporting hanging files are themselves supported by channel defining elements extending inwardly from end panels of the box. The channel defining elements have closed sides and a closed bottom, and a closed end defined by the end panel. The metal file supporting bars may be moved in place supported by the channel elements by moving them downwardly through openings in the tops of the elements defined by beveled surfaces, or inserted through the open ends of the channels. The length of the bars is essentially the same as the spacing between the end panels when they are vertical and support the container in its operative (erected) position.

9 Claims, 6 Drawing Sheets

FIG. 1
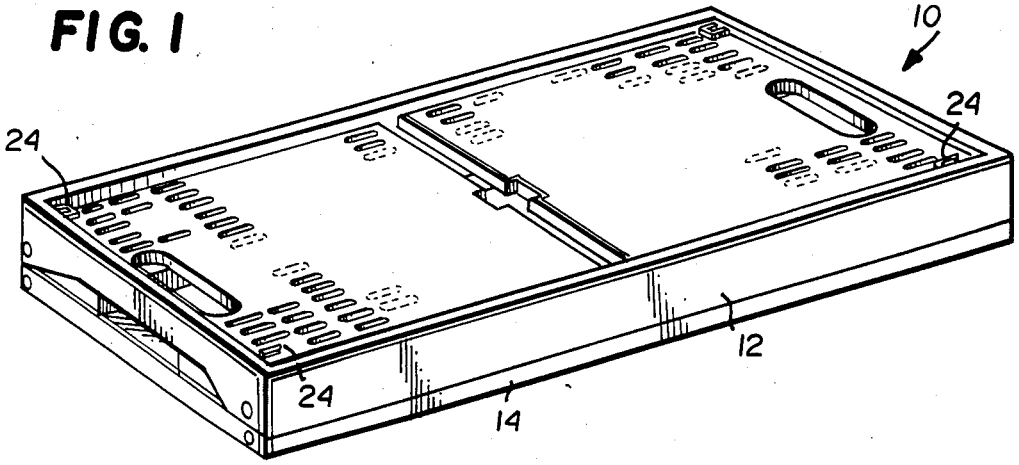
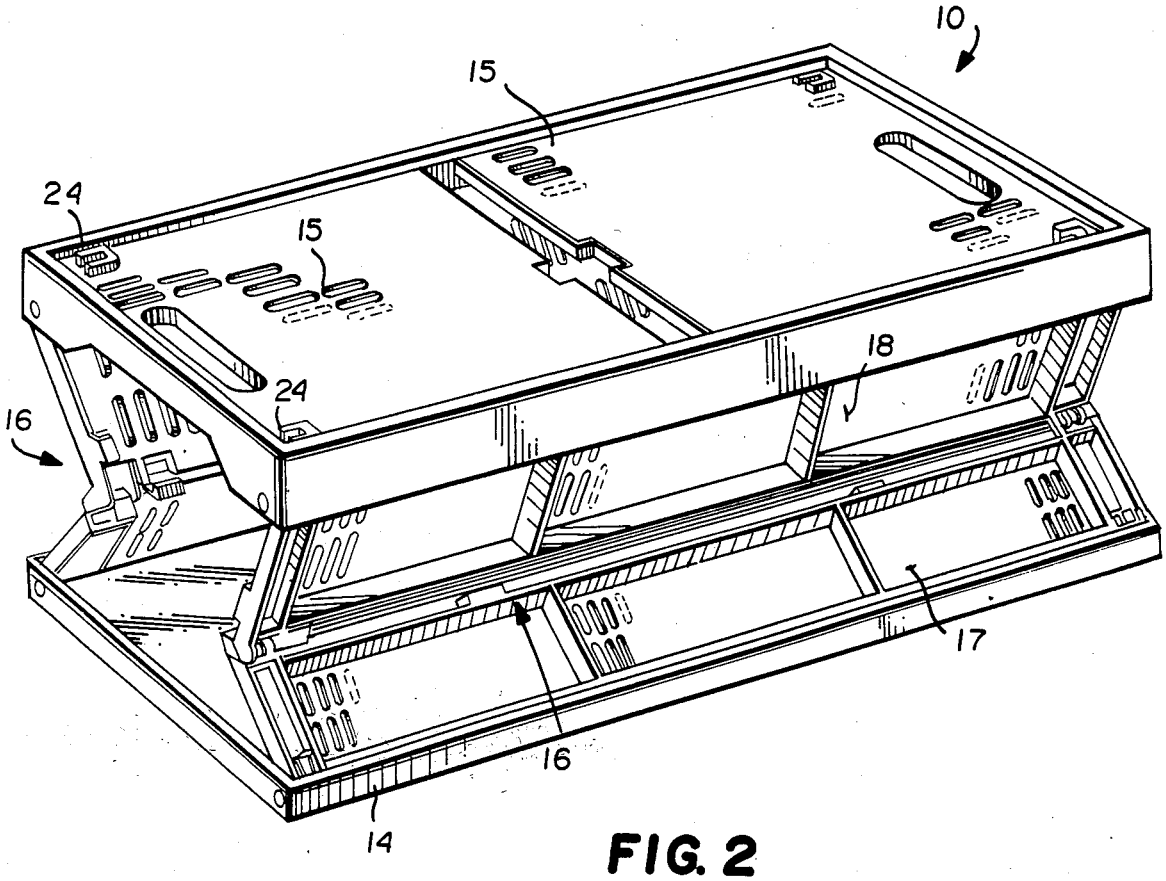
FIG. 2

COLLAPSIBLE BOX

BACKGROUND AND SUMMARY OF THE INVENTION

Collapsible containers or boxes for storing or holding papers or objects when erected, while collapsing to a low volume configuration for storage or transportation, have become increasingly popular in the last few years. Such boxes, such as those manufactured under the trademark "Snap Box" by Monoflo International, Inc. of McLean, Va., "MultiBox" manufactured by Nijhof Luxe Metaalwaren BV of Zevenaar, Holland, and such as illustrated in U.S. Pat. No. 4,693,387, have found good commercial acceptance. While such products are highly desirable, there are a few drawbacks associated with the products.

When the collapsible boxes are used for hanging files, if the boxes have a tendency to collapse, they may damage materials which they are holding, or otherwise present them in an unacceptable manner. With past commercial systems, such as illustrated in said U.S. Pat. No. 4,693,387, due to the fact that the metal bars for supporting the files pass through openings in the end walls of the box, if those end walls tended to move inwardly and collapse for any reason, freedom of movement between the end wall and the metal bar was provided. Additionally, with such prior collapsible boxes, it is necessary to bend or flex the metal bars in order to insert them within the container, the bending or flexing action being a less than desirable procedure under many circumstances.

Additionally, conventional collapsible boxes have utilized metal rods which serve as pivot pins for allowing the relative pivotal movement between the components that results in a collapsing action. Such metal rods must be specifically inserted during manufacture, and typically are not readily removable once manufacture is completed. This means that the collapsible box can only be disassembled in the field with great difficulty, and the metal rods are relatively expensive components of the products.

According to the present invention, the drawbacks set forth above have been eliminated. The collapsible container according to the invention is movable from a collapsed to an operative (erected) position, and vice-versa. It has a number of aspects in common with the prior art products. For example, the collapsible container comprises the following elements: Two sides; two ends; an open top form comprising two side bars and two end bars; and a bottom panel; interconnected to form a generally rectangularly shaped structure. The two sides are each composed of first and second panels, the first and second panels pivotally connected to each other. The first panel is pivotally connected to the bottom panel, and the second panel is pivotally connected to a side bar of the top form, so that the first and second panels are pivotal with respect to each other and the top form and bottom panel about parallel side axes. The two ends comprise end panels each of which spans the distance between the bottom panel and top form when the container is in the operative position, to maintain the container in the operative position. The end panels are each pivotally connected to an end bar of the top form for rotation about an end axis generally perpendicular to the side axes. The sides, end, top form, and bottom panel all comprise plastic components.

In addition, according to the present invention the pivotal means for pivotally connecting all of the components together consist essentially of plastic pivot pins integral with the plastic components, and means defining pivot pin receiving openings in the plastic components for receipt of the plastic pivot pins. The pivotal means comprise elements that snap together and snap apart so that the container components may be easily assembled together, and taken apart, without the necessity of removing elements that have been specially inserted to pivotally connect the components together (such as the metal pins in prior art collapsible boxes). The pivot pins are provided in a wide variety of forms including tapered free end pins connected to flexible arms, or closed end pins which are received between cantilevered flanges and other surfaces of the plastic components of the container.

Further, the containers according to the invention comprise means for supporting hanging files having hooks projecting from upper corners thereof, using metal file supporting bars. The supporting means comprise at least four channel defining elements comprising at least two elements connected to each of the end panels. Each of the channel defining elements comprises a pair of side walls, a bottom wall, and a closed end wall formed by the end panel, and defines an open end opposite from the closed end wall. At least two, and preferably all, of the channel defining elements define an open top. The open ends of the channel defining elements connected to one end panel face the open ends of the channel defining elements connected to the other of the end panels when the container is in the operative (erected) position. By moving the metal file supporting bars downwardly into the open tops of the channel defining elements, one snaps the bars into place between the end panels of the container. The ends of the metal bars engage the end panels of the container so as to prevent movement of those end panels toward each other, thereby eliminating the relative movement between the bars and end panels that may occur in prior art boxes.

It is the primary object of the present invention to provide a simple, inexpensive, and versatile collapsible container. This and other objects of the invention will become clear from an inspection of the detailed description of the invention and from the appended claims.

BRIEF DESCRIPTION OF THE DRAWINGS

FIG. 1 is a top perspective view of an exemplary collapsible box according to the invention illustrated in its collapsed position;

FIG. 2 is a top perspective view of the box of FIG. 1 in an intermediate position between its collapsed and operative positions;

DETAILED DESCRIPTION OF THE DRAWINGS

Figure 3:
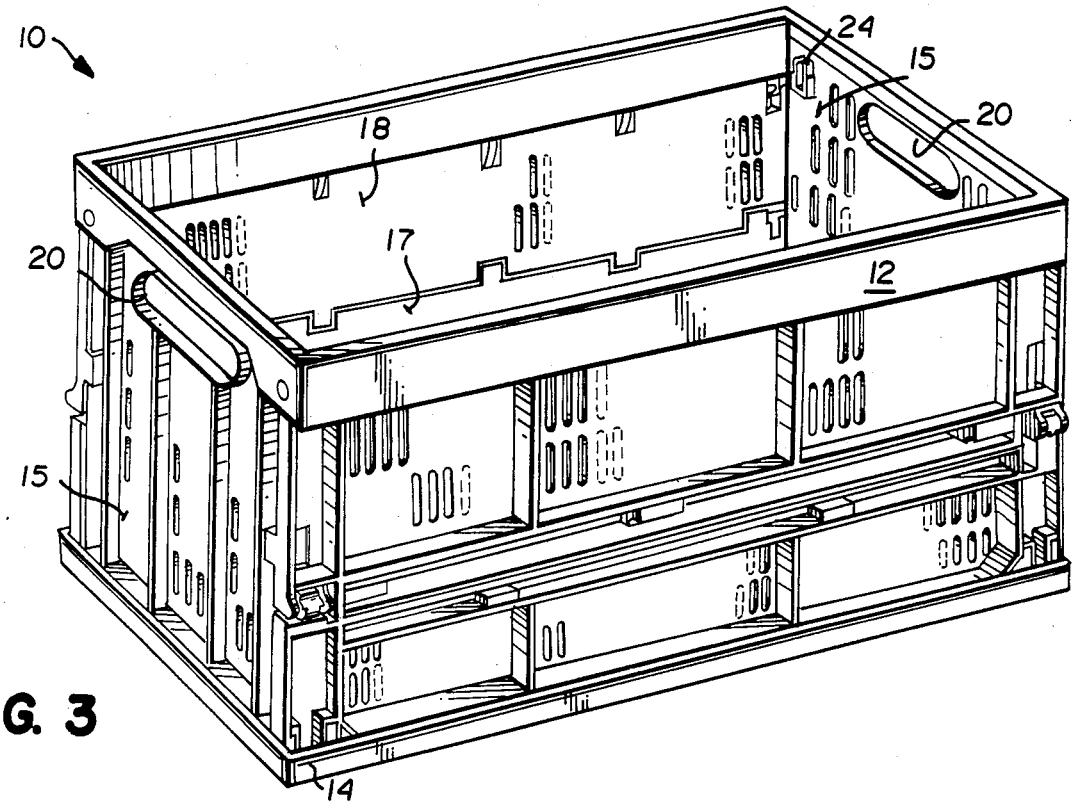
FIG. 3 is a top perspective view of the box of FIG. 1 in an operative (erected) position.
Figure 4:
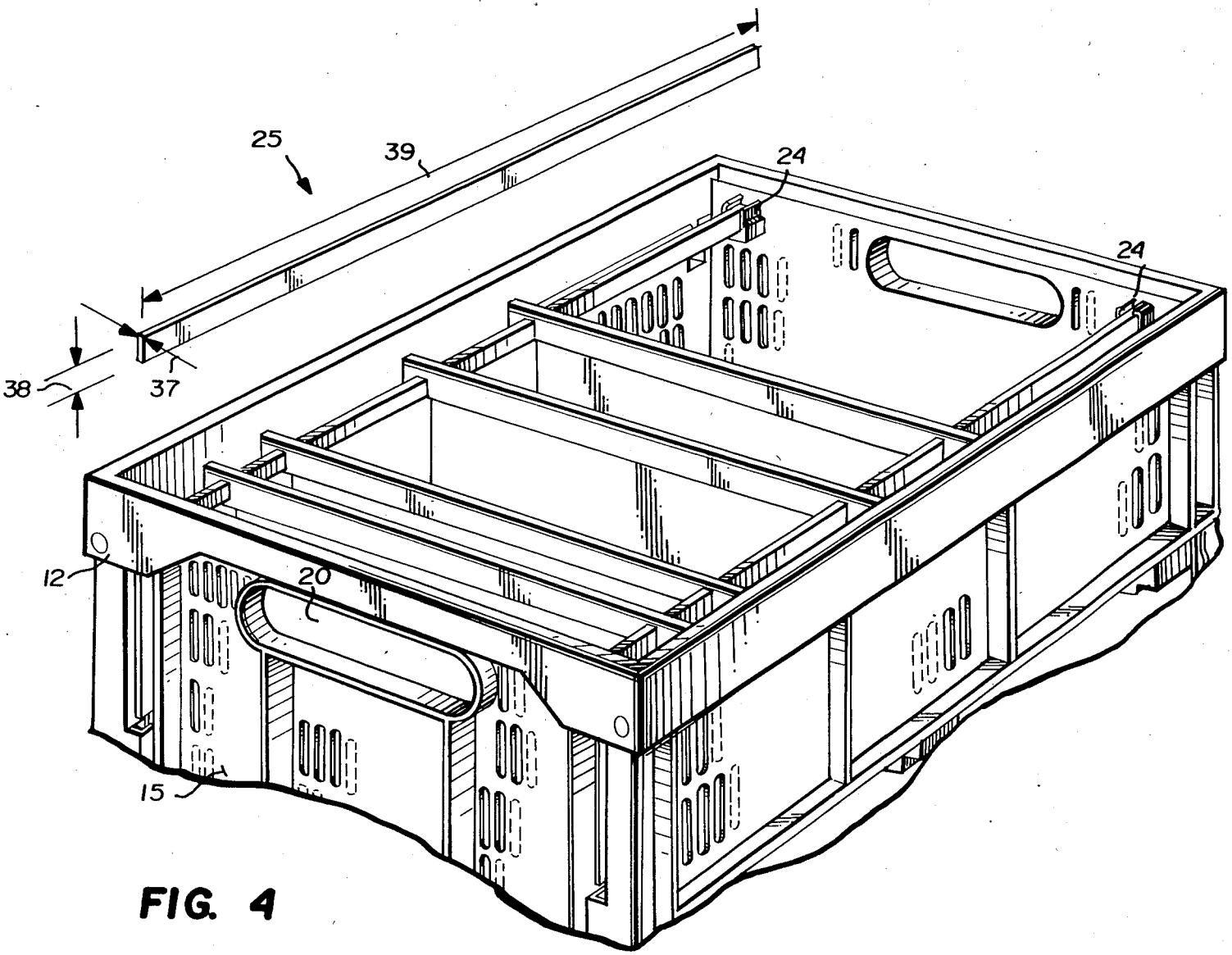
FIG. 4 is a top end perspective view of the top portion of the box of FIG. 3 showing the inter-relationship between the metal file supporting bars and the channel defining elements thereof.
Figure 10:
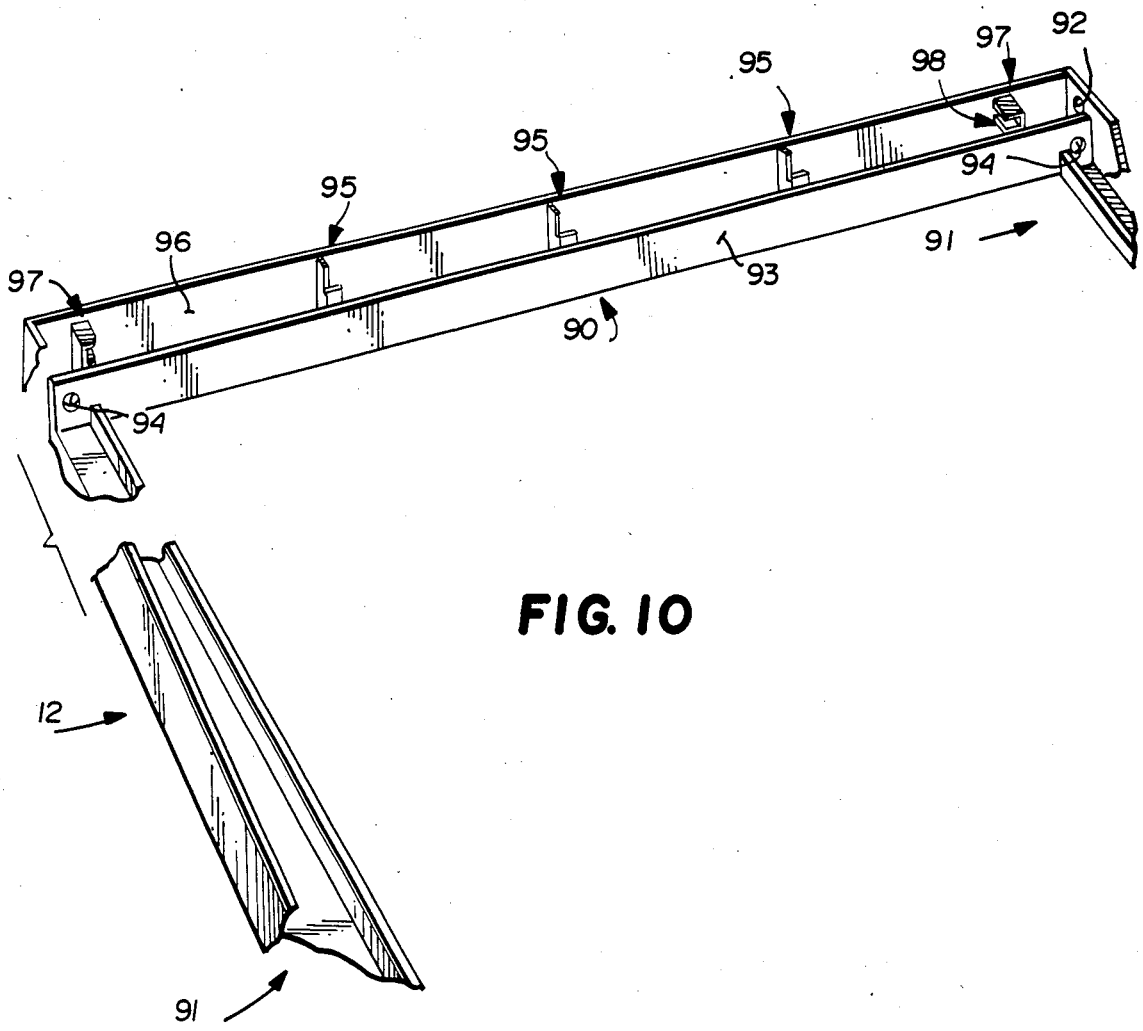
FIG. 10 is a bottom perspective, detail view showing operative components of the top form element of the collapsible box of FIGS. 1 through 4.

The collapsible container 10 according to the present invention is movable from the collapsed position illustrated in FIG. 1, through the intermediate position illustrated in FIG. 2, to the operative (erect) position illustrated in FIGS. 3 and 4, and vice-versa. The generally conventional elements of the container 10 include the open top form 12, the bottom panel 14, the two ends or end panels 15, and the two sides 16. Each of the sides are composed of first and second panels 17, 18 and are pivotally connected together at a center portion of the sides 16, as clearly illustrated in FIG. 2. The first panels 17 are pivotally connected to the bottom panel 14, and the second panels 18 are pivotally connected to a side bar of the top form 12 so that the first and second panels are pivotal with respect to each other and the top form and bottom panel about parallel side axes (e.g. axes 19 in FIG. 2). The open top form 12 includes two side bars and two end bars, which are best seen in FIG. 10.

The two end panels 15 span the distance between the bottom panel 14 and the top form 12 when the box 10 is in the operative position (see FIG. 3) to maintain the container in the operative position. The end panels 15 are each pivotally connected to the top form for rotation about an end axis generally perpendicular to the side axes 19. The end panels 15 typically have means defining openings 20 therein so that an individual can insert his/her fingers or hands through the openings 20 and lift the container 10 when it is in its operative (FIG. 3) position.

According to the present invention, means are provided for supporting conventional hanging files 21, such as illustrated in U.S. Pat. No. 3,682,522, therein. The conventional hanging files 21 have hooks projecting from upper corners thereof. The supporting means comprises at least four channel defining elements 24, which are most clearly seen in FIGS. 3 through 5. The channel forming elements 24 are integral with the side panels 15 of the container 10, typically being formed of the same plastic, and at the same time, that the end panels 15 are injection molded. At least two of the elements 24 are connected to each of the side panels 15, in alignment with each other, so as to support metal bars 25 (see FIG. 4), which support the files 21 within the container 10.

Figure 5:
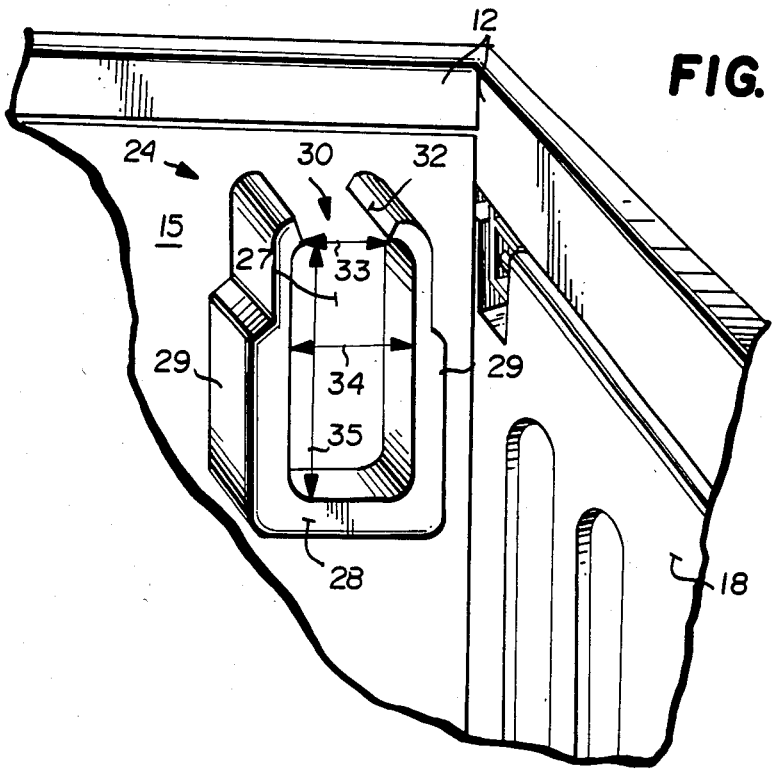
FIG. 5 is a detail perspective view of a channel defining element of the box of FIGS. 1 through 4.

A typical channel defining element 24 is illustrated most clearly in FIG. 5. Note that the element 24 is exaggerated in size in the drawings for clarity of illustration, but typically it would only extend a small distance (e.g. about 0.14 inches) from the end panel 15 inwardly of the box. The element 24 includes a bottom wall 28, a pair of side walls 29, a closed end wall defined by the panel 15, and an open end 27 opposite the end wall 15, and facing inwardly of the box 10 when in the operative position (see FIGS. 3 and 5). At least two non-cooperating elements 24 also define an open top 30 which includes a top curved portion of the side walls 29 terminating in beveled surfaces 32. The surfaces 32 have a slight angular slope, for example about 4°–10° (e.g. 6°) from vertical. Preferably all of the elements 24 have an open top 30 as illustrated in FIG. 5, but, for example, it is possible to provide two of the elements 24 on one end panel 15 with open tops and the two on the other end panel 15 with closed tops requiring that a metal bar 25 be inserted into a closed top element before it is moved into operative association with an open topped element.

The elements 24 are dimensioned so that they cooperate with the metal file supporting bars 25 (compare FIGS. 4 and 5). For example, the dimension 33 between the surfaces 32 is just slightly less than the width 37 of a bar 25, while the dimension 34 is just slightly greater than the width 37. The height 35 of the channel of each element 24 is preferably just slightly greater than the height 38 of the bar 25. The beveled surfaces 32 facilitate entry of an end of the bar 25 into the channel, being moved outwardly with respect to each other so that the bar 25 snaps into place within the channel and is tightly held within the channel unless a relatively large upward force is exerted thereon.

The length 39 (see FIG. 4) of each of the bars 25 is just slightly less than the spacing between the end panels 15 when the box is in the operative position of FIGS. 3 and 4, with those end panels 15 essentially vertical. Each metal bar 25 passes through the open end 27 of each channel into the channel, and prevents the end panels 15 from moving toward each other, by abutting the end panels 15 and positively preventing such movement. Thus when the container 10 according to the invention is as illustrated in FIG. 4, the bars 25 contribute to the rigidity of the structure and prevent the collapse thereof even if a sideward force should be exerted on the end panels 15. Note that the file supporting components are also much more easily moved into operative association with each other than in prior art collapsible boxes since there is no necessity to flex the bars 25 in order to move them into place.

According to another aspect of the present invention, the box 10 is constructed inexpensively and advantageously by providing all of the structures which pivotally connect the components together as integral with the components themselves, being of plastic (and preferably injection molded at the same time that the components are molded). This construction also allows the components of the container to be disassembled in the field for replacement or repair, and readily reassembled. The pivotal means for pivotally connecting all of the components together consist essentially of plastic pivot pins integral with the plastic components, and means defining pivot pin receiving openings in the plastic components for receipt of the plastic pivot pins. While the exemplary pivotal means illustrated in FIGS. 6 through 10 will be described in detail, it is to be understood that they could depart from the exact configurations illustrated therein as long as they perform their intended desired functions.

Figure 6:
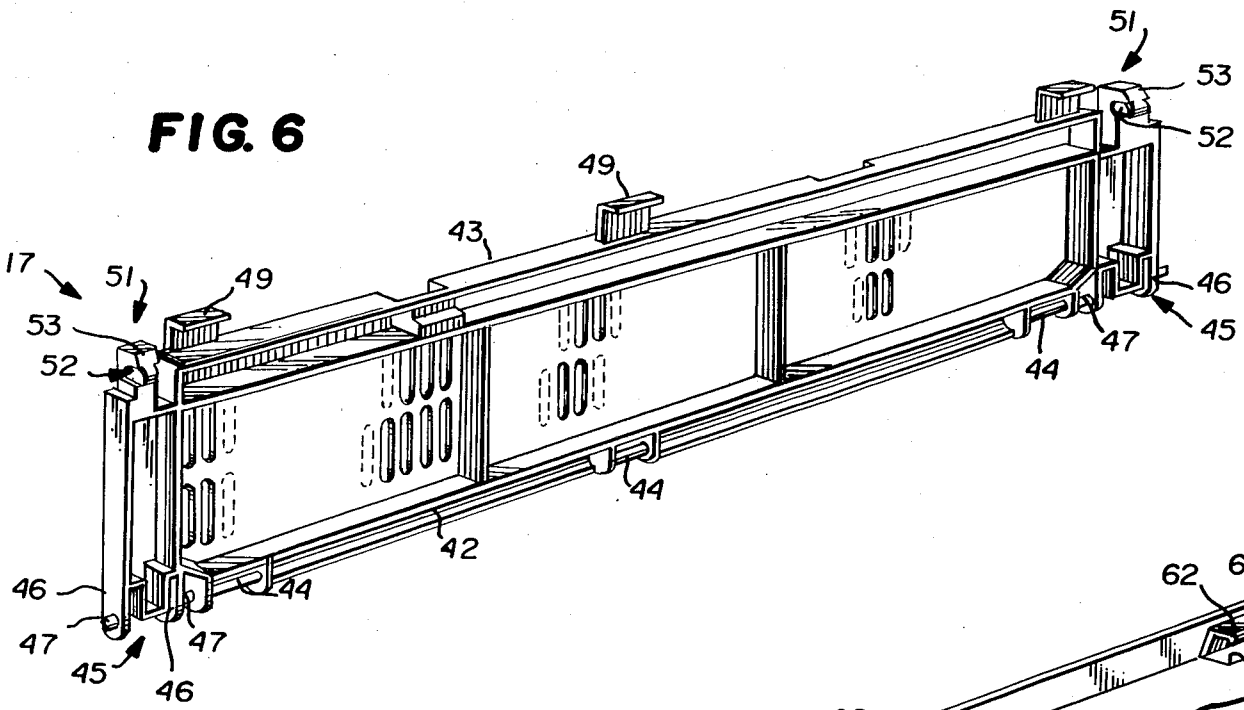
FIG. 6 is a perspective view of a bottom side panel of the box of FIGS. 1 through 4.

A first (side) panel 17 is illustrated in FIG. 6. It includes a bottom portion 42 and a top portion 43. Associated with the bottom portion 42 are plastic pivot pins 44 which are "closed end", connected to part of the side panels 17 at both ends thereof. Also providing pivoting action are the pivotal means 45 which are provided at opposite ends of the panel 17. The means 45 are preferably defined by a pair of flexible arms or webs 46 at each end of the panel 17, which have free ends, and which include pivot pins extending outwardly (sidewardly)

therefrom. The pivot pins 47 preferably are disposed so that the pins 47 associated with each pair of arms 46 have free ends extending outwardly from each other. As illustrated in FIG. 6, the free ends of those pins 47 are tapered so that the length of each pin 47 is least nearest the free end of the arm 46 with which it is associated. The degree of taper may be any amount desired for facilitating easy entry of the pins 47 into their cooperating pivot pin receiving openings (e.g. between about 10°–40°).

Associated with the top 43 of the first panel 17 are a plurality of recesses 48 and hooked flanges 49. These are conventional components which cooperate with like conventional components on the second side panel 18 to provide rigidity to the sides 16 of the container 10 when in its operative position. Also associated with the top 48 are arch defining means 51 which include integral pieces of plastic 53 formed in an arch configuration, and defining the pivot pin receiving openings 52 for cooperation with pivot pins (hereafter described) formed on the second panel 18.

Figure 7:
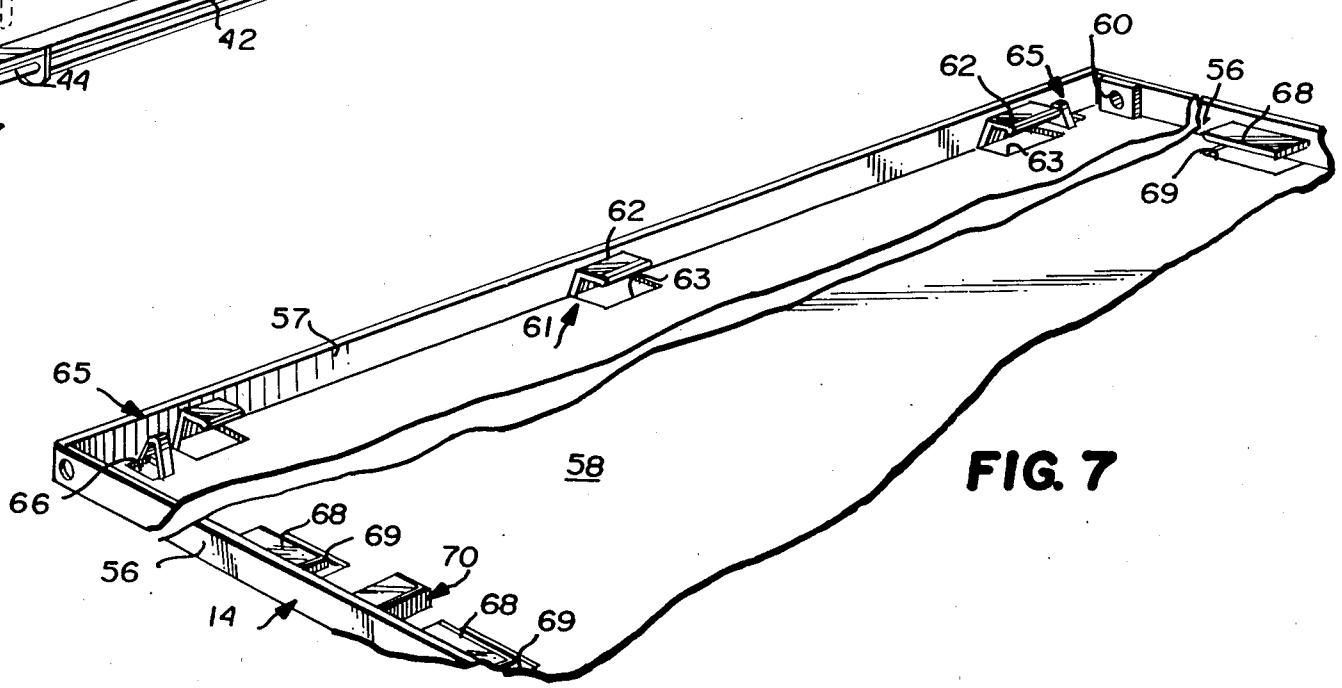
FIG. 7 is a detail perspective view of operative portions of the bottom panel of the box of FIGS. 1 through 4.

The exemplary bottom panel 14 according to the invention is illustrated in FIG. 7, and particularly specific structure thereof cooperating with the first (side) panel 17, and additionally with an end panel 15, is shown in detail. The bottom panel 14 includes a bottom plate 58, and upstanding side walls 56, 57. The upstanding side walls 56 have means defining pivot pin receiving openings 60 therein which receive the outwardmost of the pins 47 of the panel 17. As seen at the top of FIG. 7, the side wall 56 may have increased thickness where it defines the opening 60. The bottom panel 14 also includes pivot receiving means 61 which cooperate with the closed end plastic pivot pins 44. Each of the means 61 includes a flange 62 cantilevered from wall 57 and having a hooked bottom 64 and cooperating with a surface 63 of the bottom plate 58 for holding the pin 44 for providing pivotal movement between the panel 17 and the panel 14. Obviously the width of the flange 62 is slightly less than the length of the pin 44.

As part of the pivotal connection between the panels 17, 14, means defining the arch 65, with pin receiving opening 66 therein, is provided. The opening 66 defined by the arches 65 receive the inwardly extending ones of the pins 47 therein. Thus it will be seen that the pins 47 received by the openings 60, 66, and the pins 44 received in the openings or spaces between the flanges 62 and the bottom plate 58, provide a pivotal connection between the panels 17, 14 to allow them to move from the collapsed to the operative position. Despite the fact that they effectively provide for the pivotal action, these pivotal components allow for ready assembly of the components together so that they snap into place (not requiring any separate pin insertion steps), and also allow (although it is more difficult than insertion) detachment between the components for replacement or repair of individual panels.

The bottom panel 58 also includes other structures which cooperate with the end panels 15. These include the ledges 68 cantilevered from side walls 56 disposed over opening 69 which receive a bottom portion of the side panel 15 as is conventional, and a guide support 70 which is received by a channel formed in the bottom of an end panel 15, also as is conventional.

Figure 8:
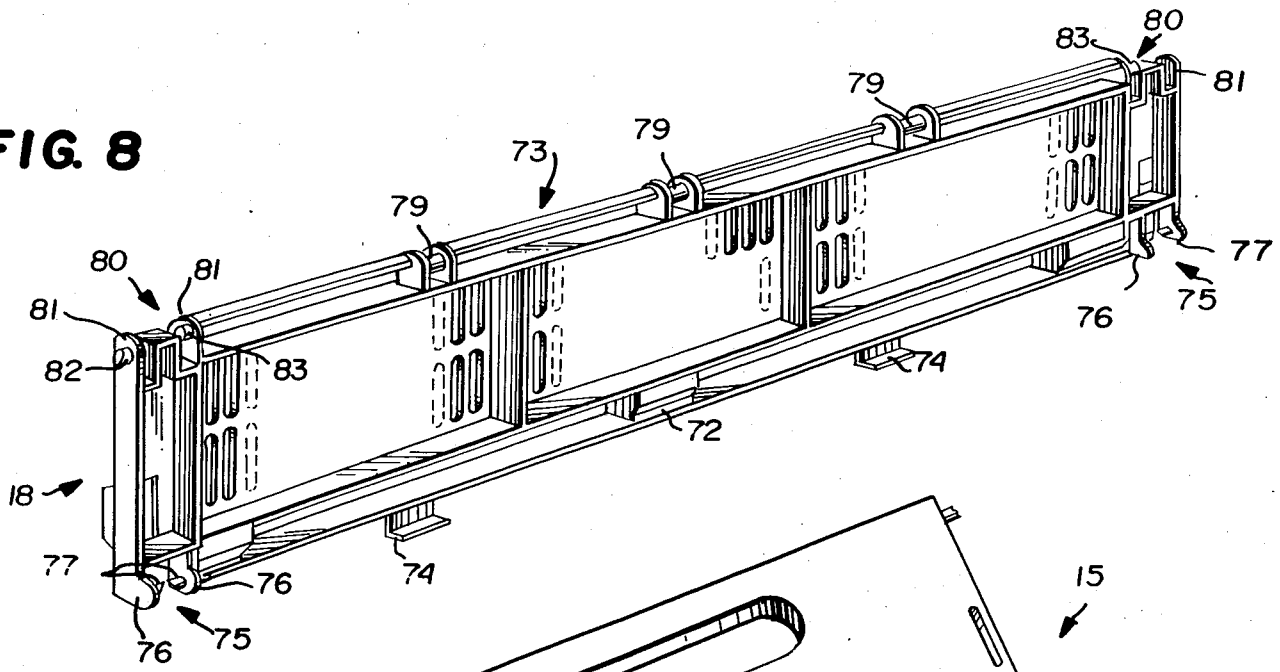
FIG. 8 is a perspective of an exemplary top side panel of the box of FIGS. 1 through 4.

The second (side) panel 18 is illustrated in FIG. 8. It includes the conventional recesses 72 and hooked flanges 74 that cooperate with the corresponding components 48, 49 of the panel 17, and end pivot means 75. The end pivot means 75 include free-ended arms or webs 76 each having a pivot pin 77 associated therewith. As illustrated, preferably a pair of arms 76 is provided associated with each end of the panel 18, and the pins 77 are provided so that the free ends thereof face toward each other. The pins 77 are tapered so that the length of the pins 77 is least nearest the free end of each arm 76. The taper of the pins 77 can be the same as for the pins 42 described with respect to FIG. 6. Note that the pins 77 snap into engagement with, and are received by, the openings 52 in the arches 53 of the first panel 17.

Associated with the top 73 of the panel 18 are the components that cooperate with the top form 12 to provide pivotal connection between the panel 18 and the top form 12. These elements include a plurality of closed end plastic pivot pins 79, and the end structures 80. The end structures 80 include pin supports 81, 81' having pivot pins 82, 83 respectively associated therewith. The pin support walls 81 are relatively flexible, and the pins 82 have tapered surfaces so that the length of the pin 82 is least closest to the free end of the wall 81. The pins 83, which are connected to the relatively inflexible walls 81', have flat end terminations. The pins 82, 83 both extend outwardly from their respective walls 81, 81'.

Figure 9:
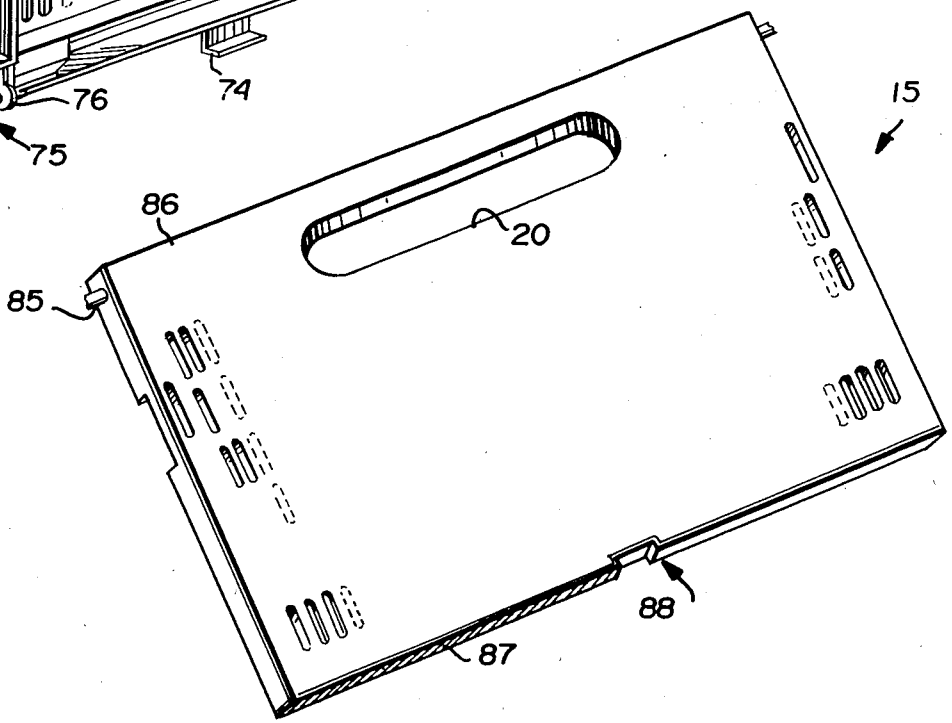
FIG. 9 is a perspective view of an exemplary end panel of the box of FIGS. 1 through 4 (shown without the channel defining elements merely for simplicity of illustration)

FIG. 9 illustrates details of an exemplary end panel 15 having an hand receiving opening 20. A pair of pivot pins 85 are provided extending outwardly from side walls 86 of the end panel 15. The plastic pivot pins 85, which are integral with the end panel 15, have tapered free ends to facilitate their connection to pivot pin receiving openings in the top form 12. That is the length of each pin 85 is the least adjacent the top of the side wall 86 with which it is associated.

The bottom portion 87 of the end panel 15 is received beneath the flanges 68 of the bottom panel 14 (as described with respect to FIG. 7), and the channel shaped recess 88 receives the structure 70 of the panel 14, as is conventional.

FIG. 10 illustrates the bottom of the top form 12, which has side bars 90 and end bars 91. Means are provided defining openings 92 in the portions of end bars 91 closest to the side bars 90, as illustrated in the righthandmost side of FIG. 10. The openings 92 receive the pivot pins 82 of the second panel 18 (FIG. 8). The side bars 90 each also include side webs 93 spaced from the exterior, main portions 96 of the side bars 90. Means are provided defining a pivot pin receiving opening 94 at the ends of each of the side webs 93, the openings 94 receiving the pivot pins 85 from the end panels 15 (see FIG. 9) therein. In this way the pivot pins 85 are not visible from the exterior of the container 10.

Side bars 90 also include the means 95 defining substantially J-shaped openings for receipt of the pivot pins 79, and the side facing channel means 97 which define the channel openings 98. The channel openings 98 receive the pivot pins 83 of the top panels 18. Thus the elements 82, 92; 83, 98; and 79, 95 cooperate to provide the relative pivotal movement between the top panels 18 and the top form 12.

It will thus be seen that according to the present invention it is possible to produce a collapsible box solely of plastic, without the necessity of any metal pivot pins or the like. The box so produced is less expensive than prior art boxes containing metal pivot pins, and additionally is easier to assemble, the component parts snapping into place with respect to each other. Also the components can be disassembled when necessary to provide for replacement or repair thereof. The collapsible box according to the invention also provides for ready receipt of metal bars for holding file holders therein, those bars being easily moved into place (without the necessity for flexing thereof) in association with the end walls of the box when in the operative position, and abutting those end walls to prevent relative movement between the end walls and the bars when the bars are in place.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A collapsible container movable from a collapsed to an operative position, and vice versa, and comprising:

two sides; two ends; an open top form comprising two side bars and two end bars; and a bottom panel; interconnected to form a generally rectangularly shaped structure;

said two sides each composed of first and second panels, said first and second panels pivotally connected at a center portion of the sides to each other, and said first panel being pivotally connected to said bottom panel, and said second panel being pivotally connected to a side bar of said top form, so that said first and second panels are pivotal with respect to each other and said top form and bottom panel about parallel side axes;

said two ends comprising end panels each of which span the distance between said bottom panel and top form when in said operative position to maintain said container in said operative position; said end panels each pivotally connected to an end bar of said top form for rotation about an end axis generally perpendicular to said side axes;

said sides, end, top form, and bottom panel all comprising plastic components;

pivotal means for pivotally connecting all of said components together, said pivotal means consisting essentially of plastic pivot pins integral with said plastic components, and means defining pivot pin receiving openings in said plastic components for receipt of said plastic pivot pins;

said pivotal means including four flexible arms extending downwardly from each of said first panels when said container is in said operative position, each of said flexible arms having a pivot pin extending outwardly therefrom, each pivot pin having a tapered free end so that the length of said pin is least nearest the bottom of said first panel; and a pair of said arms adjacent each end of said first panel, the pivot pins of each pair of arms facing away from each other;

said bottom panel comprising a bottom plate and upstanding side walls; said pivotal means for connecting each of said first panels to said bottom panel further comprising a plurality of closed end pivot pins connected at both ends thereof to part of said first panel; and said means for receiving said closed end pivot pins comprising said bottom panel and a hooked bottom flange cantilevered to a side wall of said bottom panel.

2. A container as recited in claim 1 wherein said pivotal means include a pivot pin extending outwardly from the side of a top portion of each of said end panels, and having a tapered free end so that the length of said pin is least at the part thereof nearest the top of said end panel; and wherein said top form comprises a side web adjacent each of said side bars, said side web spaced from its adjacent side bar and integral therewith; said means defining a pivot pin receiving opening for each of said end panel pivot pins provided in said side web so that no opening for receipt of said pivot pin is visible from the exterior of said top form.

3. A container as recited in claim 1 wherein said means defining pivot pin receiving openings for said first panel pins comprise means defining openings in side walls of said bottom panel, and an arch integral with the bottom of said bottom panel and extending upwardly therefrom.

4. A container as recited in claim 1 wherein said pivotal elements for connecting said first and second panels together comprise a plurality of flexible arms extending from one of said first and second panels toward the other and having a pivot pin extending sidewardly from each arm; and means defining an arch extending from the other of said first and second panels toward the other, said arches defining said means for receiving said pivot pins.

5. A container as recited in claim 4 wherein a pair of said arms is provided on each end of said second panel, the pivot pins associated with each pair of arms facing toward each other, and having a tapered free end such that the pivot pin has the least length closest to said first panel; and wherein each of said arches is open at both sides thereof, and receives both of said pivot pins associated with each pair of arms.

6. A container as recited in claim 4 further comprising cooperating hooked flange and recess means formed in the top of one of said first and second panels, and the bottom of the other of said first and second panels, cooperating to provide rigidity to the sides of said container when in said operative position.

7. A container as recited in claim 1 wherein said pivotal means comprise elements that snap together, and are disassemblable, so that said container components may be easily assembled together, and may be taken apart, without the necessity of removing accessory elements that have been specifically inserted to pivotally connect the components together.

8. A container as recited in claim 1 wherein said pivotal means includes a plurality of flexible arms extending upwardly from each of said second panels when said container is in said operative position, each of said flexible arms having a pivot pin extending outwardly therefrom, each pivot pin havin a tapered free end so that the length of said pin is least nearest the top of said second panel; and wherein said means for receiving said pivot pins extending outwardly from the top of said second panel comprises means defining openings in the end bars of said top form adjacent said side bars.

9. A container as recited in claim 8 wherein said pivotal means for connecting each of said second panels to said top form further comprises a plurality of closed end pivot pins connected at both ends thereof to part of said second panel, and wherein said means for receiving said closed end pivot pins comprises means defining J-shaped recesses in said top form; and a pair of free end outwardly extending pivot pins spaced inwardly from said tapered pivot pins, said free ended pivot pins being received within means defining side facing channels formed in said side bars.

* * * * *